US008037789B2

(12) United States Patent
Tanger

(10) Patent No.: US 8,037,789 B2
(45) Date of Patent: Oct. 18, 2011

(54) WALL ANCHOR INSTALLATION DEVICE

(76) Inventor: Jonathan Paul Tanger, Plantation, FL (US)

( * ) Notice: Subject to any disclaimer, the term of this patent is extended or adjusted under 35 U.S.C. 154(b) by 0 days.

(21) Appl. No.: 12/470,029

(22) Filed: May 21, 2009

(65) Prior Publication Data

US 2010/0294093 A1 Nov. 25, 2010

(51) Int. Cl.
*B25B 23/08* (2006.01)
*B25B 15/00* (2006.01)

(52) U.S. Cl. ..... 81/452; 81/439

(58) Field of Classification Search ..... 81/436–439, 81/452, 461, 442, 443, 448, 185, 124.4
See application file for complete search history.

(56) References Cited

U.S. PATENT DOCUMENTS

| | | | | | |
|---|---|---|---|---|---|
| 138,528 | A * | 5/1873 | Reed et al. | ..... | 81/488 |
| 1,345,708 | A * | 7/1920 | Schneider | ..... | 81/439 |
| 1,471,451 | A * | 10/1923 | Crimp | ..... | 81/185 |
| 1,501,222 | A * | 7/1924 | Lamp | ..... | 81/439 |
| 2,735,325 | A * | 2/1956 | Rudd, Sr. | ..... | 81/439 |
| 4,060,114 | A | 11/1977 | Matsushima | | |
| 4,363,250 | A | 12/1982 | Suga | | |
| 4,447,923 | A | 5/1984 | Bond et al. | | |
| 4,899,431 | A | 2/1990 | Borntrager | | |
| 4,930,963 | A | 6/1990 | Rockenfeller et al. | | |
| 5,591,207 | A | 1/1997 | Coleman | | |
| 5,791,212 | A | 8/1998 | Han | | |
| 6,082,233 | A | 7/2000 | Han | | |
| 6,209,426 | B1 | 4/2001 | Takahashi | | |
| 7,065,855 | B2 | 6/2006 | Janusz | | |
| 7,387,051 | B1 * | 6/2008 | Chiang | ..... | 81/124.4 |
| 7,481,138 | B1 * | 1/2009 | Chapin | ..... | 81/442 |

* cited by examiner

*Primary Examiner* — Hadi Shakeri
(74) *Attorney, Agent, or Firm* — Gold & Rizvi, P.A.; H. John Rizvi; Glenn E. Gold

(57) ABSTRACT

A drywall anchor installation device comprising, inter alia, a main driver member configured to engage a Philips head screw top, a plunger member configured to engage a Philips head screw top, and a plunger member guiding mechanism including a compression spring and a guide pin. In operation, the main driver member engages a drywall anchor at the Philips head indentation and the plunger member extends inside the axial bore of the anchor until contacting the interior surface of the axial bore or the closed end of the anchor. Once contact is made with the closed end of the anchor, the compression spring of the plunger guiding mechanism is engaged, stabilizing the anchor as the anchor is driven into the wall. Once the anchor is driven into the wall, the plunger member is used to drive the anchor screw without having to adjust the driving device.

6 Claims, 3 Drawing Sheets

WALL ANCHOR INSTALLATION DEVICE

BACKGROUND

Figure 1:
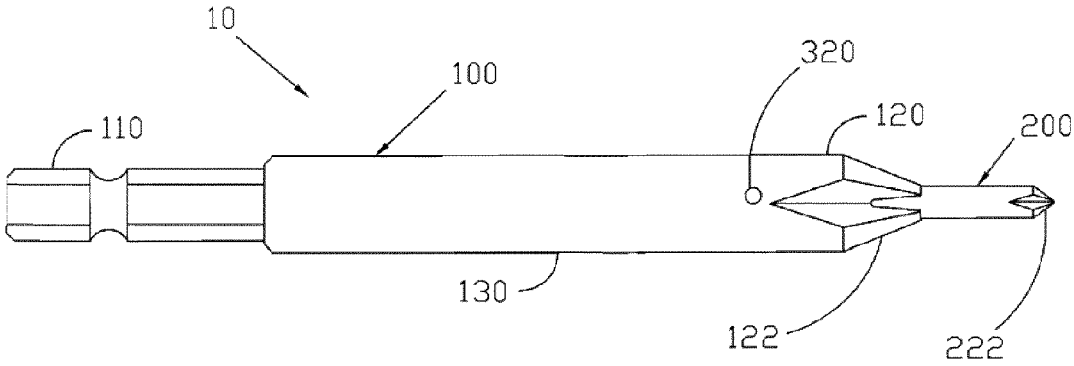

The present invention relates to installation devices, specifically devices for installing self-drilling wall anchors.

For several decades it has been common practice in the construction industry to use wall board, a material commonly referred to in the construction industry as drywall, as a building material in the construction of interior walls of commercial and residential buildings.

Due to the composition of drywall, when hanging an object on a wall made of drywall, one should use a drywall anchor or risk damaging the wall or the object being hung thereon.

Self-drilling drywall anchors are a common type of drywall anchor used in the home improvement industry. Self-drilling drywall anchors typically consist of a substantially cone shaped, open ended, threaded anchor configured to receive an anchor screw (the "anchor") and an anchor screw. It is customary that the outer portion of the anchor includes a plurality of sharp protrusions for enhancing the gripping of the anchor to the drywall.

When installing a drywall anchor, first the anchor is driven into a wall and then the anchor screw is driven into the anchor. In doing so, the anchor is contorted as the screw is driven therein. It has become the industry standard for both the open end of the anchor and the head of the anchor screw of the self-drilling drywall anchor to be configured with a cross shaped indentation, commonly referred to as a Philips head. Anchors and the corresponding anchor screws are manufactured in varying sizes depending on the need of the user.

In order to drive the anchor into the wall using conventional means, one must ensure that the anchor remains in contact with the driver device with one hand while rotating the anchor with the other hand, using a driving device, usually an electric driving device.

It is imperative that the anchor is driven perpendicularly into the wall, as the angle the anchor is driven into the wall ultimately determines the angle that the anchor screw will be driven into the wall.

It is equally important that the anchor does not slip off the driving device or wobble as the driving device is driving the anchor into the wall. In the event that the anchor slips off the driving device, the wall may be damaged. In the event that the anchor wobbles about the driving device, while the anchor is being driven into the wall, the anchor may not be driven perpendicularly into the wall or may expand the hole in the wall larger than intended; both instances could compromise the holding capacity of anchor.

The only place of contact for conventional screw driving devices to engage the anchor, when driving the anchor into the wall, is at the anchors open end. As such, in order to ensure that the anchor is driven perpendicularly into the wall, the user must use the fingers of the non driving hand or other guiding means, to ensure that the anchor (1) remains perpendicular to the wall, (2) does not slip off the driving device, and (3) does not wobble about the axis of the driving device.

In doing the above, the user risks injury to his fingers from the sharp protrusions of the rotating anchor. Furthermore, using conventional driving devices, the user risks the driving means slipping from the anchor, thereby damaging the wall or potentially injuring the user.

At the very least, when using a conventional driving device, it is likely that the anchor will wobble, thereby driving the anchor into the wall at an angle, resulting in a non-perpendicular wall mount.

The present invention was invented to address the foregoing problems. Specifically, a drywall anchor installation device comprising, inter alia, a main driver member, a plunger member, and a plunger member guiding mechanism. One end of the main driver member is configured to engage a drywall anchor with a Philips head screw top. The body of the main driver member is hollow and houses the plunger member. One end of the plunger member is configured to engage a standard Philips head screw having a head smaller than the head of the drywall anchor engaged by the main driver member.

In operation, the main driver member engages the open end of the anchor at the Philips head indentation and the plunger member extends inside the axial bore of the anchor until contacting the interior surface or the closed end of the anchor. Once contact is made with the interior surface or the closed end of the anchor, the compression spring of the plunger guiding mechanism is engaged, stabilizing the anchor and minimizing the likelihood of the anchor slipping or wobbling about the main driver member when the anchor is driven into a wall. Once the anchor is driven into the wall, the end of the plunger member configured to engage a standard Philips head screw is used to drive the anchor screw into the anchor without having to adjust the driving device.

One of the key features of the device is that the engaging means of the device, i.e. the main driver member and the plunger member, combine to contact the anchor at multiple contact points. By engaging the anchor's Philips head indentations with the main driver member while contacting the interior surface of the axial bore with the plunger member, the anchor is securely engaged to the device and the likelihood that the anchor will slip off the device or wobble about the device is greatly reduced.

An objective of the present invention is to provide a drywall anchor installation device that does not require the use of both hands when driving a drywall anchor into drywall.

Another objective of the present invention is to provide a drywall anchor installation device that engages a drywall anchor at multiple contact points of the drywall anchor.

Another objective of the present invention is to provide a drywall anchor installation device that minimizes the likelihood that a driving device will slip off an anchor when driving the anchor into drywall.

Another objective of the present invention is to provide a drywall anchor installation device that minimizes the likelihood that a driving device will wobble about the driving device when driving the anchor into drywall.

Another objective of the present invention is to provide a drywall anchor installation device that minimizes the risk of injury when driving the anchor into drywall.

Yet, a further objective of the present invention is to provide a drywall anchor installation device that minimizes the likelihood of damaging the wall when driving the anchor into drywall.

Attempts to address the problems relating to conventional fasteners can be found in Matsushima, U.S. Pat. No. 4,060,114; Han, U.S. Pat. No. 5,791,212; Han, U.S. Pat. No. 6,082,233; Takahashi, U.S. Pat. No. 6,209,426; and Bond et al, U.S. Pat. No. 4,447,923. However, each of the references is directed to conventional fastening means and attempts to address the problems relating to conventional fasteners using a sleeve member or magnetic component. Each of the references teaches a device that engages a fastener at a single contact point. Furthermore, each of the references fails to address the unique characteristics and problems associated with self-drilling drywall anchors, i.e. that a drywall anchor has a contact point at its open end and a hollow substantially cone shaped body that easily wobbles when rotated.

For the foregoing reasons there exists a need for a drywall anchor installation device comprising, inter alia, a main driver member and a plunger member and a plunger member guiding mechanism.

SUMMARY

A drywall anchor installation device comprising, inter alia, a main driver member, a plunger member, and a plunger member guiding mechanism. One end of the main driver member is configured to engage a drywall anchor with an open ended Philips head screw top. The body of the main driver member is hollow and houses the plunger member. One end of the plunger member is configured to engage a standard Philips head screw having a head smaller than the head of drywall anchor engaged by the main driver member. The plunger member guiding mechanism includes a compression spring and a guide pin.

In operation, the main driver member engages the open end of the anchor at the Philips head indentation and the plunger member extends inside the axial bore of the anchor until contacting multiple points on the interior surface of the axial bore or the closed end of the anchor. Once contact is made with the interior surface of the axial bore or the closed end of the anchor, the compression spring of the plunger guiding mechanism is engaged, stabilizing the anchor and minimizing the likelihood of the anchor slipping or wobbling about the main driver member as the anchor is driven into the wall. Once the anchor is driven into the wall, the end of the plunger member configured to engage a standard Philips head screw is used to drive the anchor screw into the anchor without having to adjust the driving device.

One of the key features of the device is that the engaging means of the device, i.e. the main driver member and the plunger member, combine to contact the anchor at multiple contact points. By engaging the anchor Philips head indentations with the main driver member while contacting the interior surface of the axial bore with the plunger member, the anchor is securely engaged to the device and the likelihood that the anchor will slip off the device or wobble about the device is greatly reduced.

DRAWINGS

Figure 2:
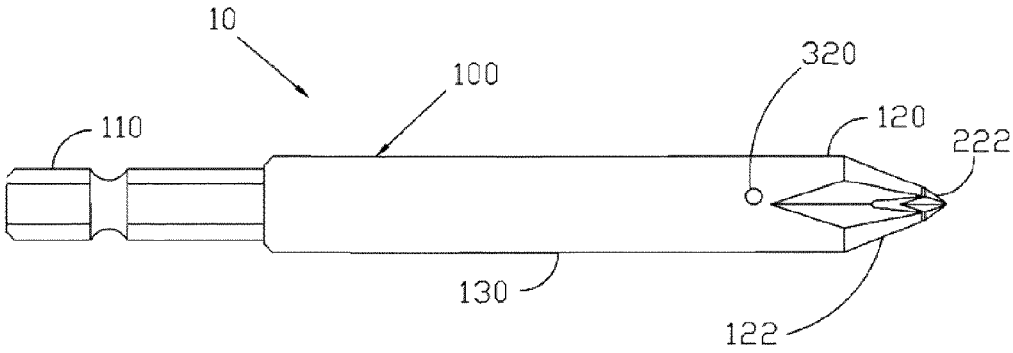
Figure 3:
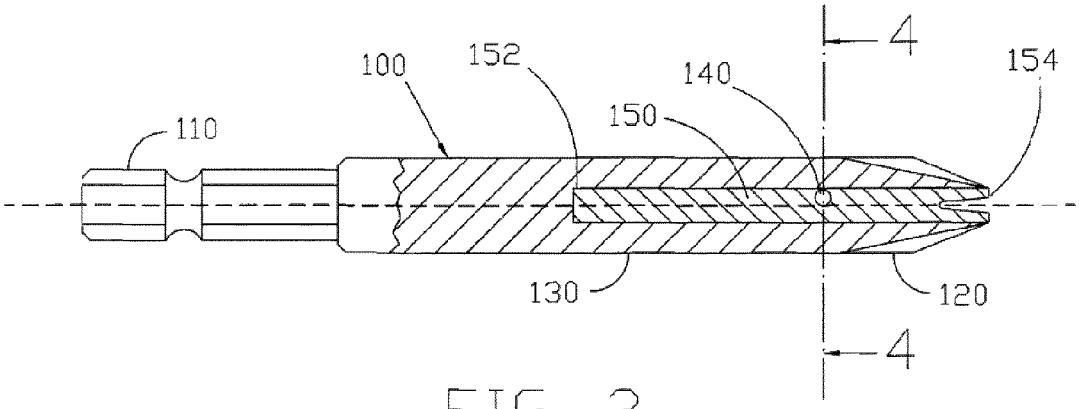
Figure 4:
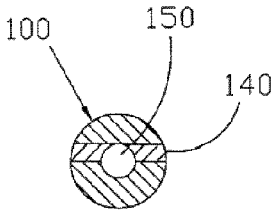
Figure 5:
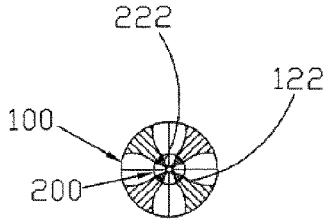
Figure 6:
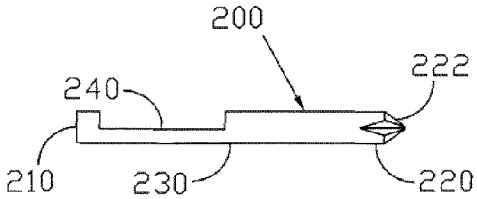
Figure 7:
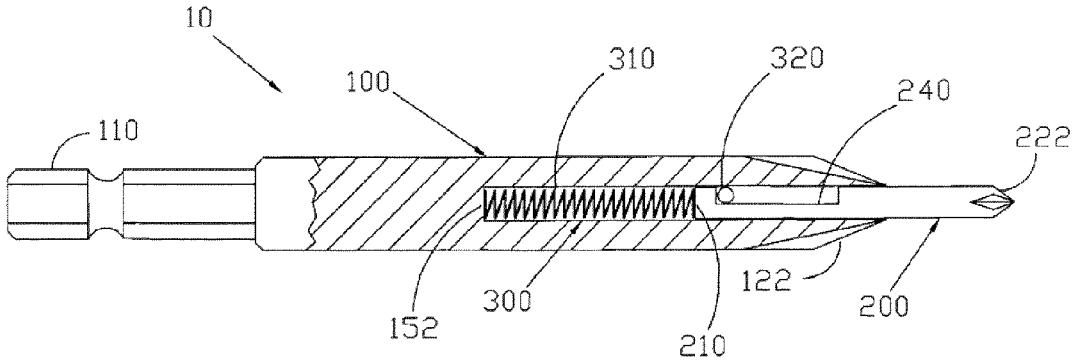
Figure 8:
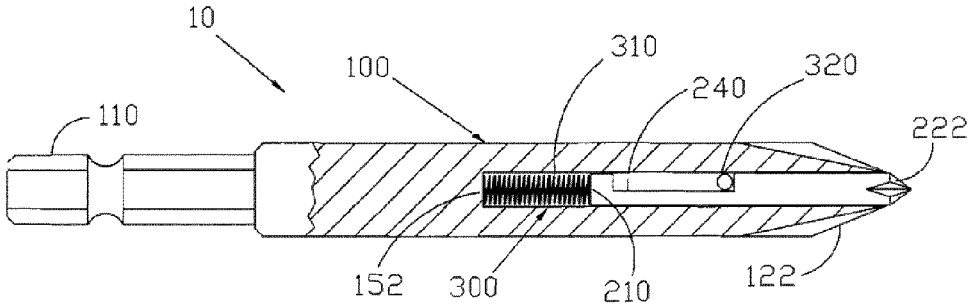

These and other features, aspects, and advantages of the present invention will become better understood with regard to the following description, appended claims and drawings where:

FIG. 1. shows a side plan view of one embodiment of the device in the extended configuration;

FIG. 2. shows a side plan view of one embodiment of the device in the compressed configuration;

FIG. 3. shows a partial cut away side plan view of one embodiment of the main driver member of the device;

FIG. 4. shows a cross section view of one embodiment of the main driver member of the device;

FIG. 5. shows a front view of one embodiment of device;

FIG. 6. shows a side plan view of one embodiment of the plunger member of the device;

FIG. 7. shows a partial cut away side plan view of one embodiment of the device in the extended configuration; and FIG. 8. shows a partial cut away side plan view of one embodiment of the device in the compressed configuration.

DESCRIPTION

As shown in FIGS. 1-8, a drywall anchor installation device 10, the device 10 comprises inter alia, a main driver member 100, a plunger member 200, and a plunger member guiding mechanism 300. The plunger member 200 is slidably housed within the main driver member 100 and the plunger member guiding mechanism 300 is operatively connected to main driver member 100 and the plunger member 200.

In one embodiment of the device 10, the main driver member 100 might have a first end 110, a second end 120, a longitudinal axis 130, a bore 140, and a central channel extending about its longitudinal axis 150. The first end 110 of the main driver member 100 might be configured to be received by a standard hexagonal driver. The second end 120 of the main driver member 100 might have engaging blades 122 in the shape of a cross (+) configured to engage a self drilling wall anchor with a Philips head screw top. The bore 140 traverses the main driver member 100 perpendicular to its longitudinal axis 130 at a position in between the first end 110 of the main driver member 100 and the second end 120 of the main driver member 100. The central channel 150 has a closed first end 152 and an open second end 154.

It is envisioned that the engaging blades 122 of the main driver member 100 might be configured to engage self drilling wall anchors of varying sizes. It is further envisioned that the main driver member 100 might be composed of a metallic compound.

In one embodiment of the device 10, the plunger member 200 might have a first end 210, a second end 220, a longitudinal axis 230, and a notch 240. The second end 220 of the plunger member 200 might have engaging blades 222 in die shape of a cross (+) configured to engage a Philips head screw having a head smaller than the head of the self drilling wall anchor engaged by the engaging blades 122 of the main driver member 100. The notch 240 might extend about the longitudinal axis 230 of the plunger member 200 at a position that is between the first end 210 of the plunger member 200 and the second end 220 of the plunger member 200. The plunger member 200 is housed in the central channel 150 of the main driver member 100 in such a way that the plunger member 200 can slide about the longitudinal axis 130 of the main driver member 100 to a predetermined extending point.

It is envisioned that the engaging blades 222 of the plunger member 200 might be configured to engage screw tops of varying sizes. It is further envisioned that the plunger member 200 might be composed of a metallic compound.

In one embodiment of the device 10, the plunger guiding mechanism 300 might comprise of a compression spring 310 and a guide pin 320. The compression spring 310 might be positioned between the closed first end 152 of the central channel 150 of the main driver member 100 and the first end 210 of the plunger member 200. The guide pin 320 might be fixedly received by the bore 140 of the main driver member 100.

It is envisioned that the guide pin 320 might be positioned so that the guide pin 320 is engaged with the notch 240 of the plunger member 200 so that the plunger member 200 is prevented from fully exiting the central channel 150 of the main driver member 100 additionally, when the guide pin 320 is engaged with the notch 240 of the plunger member 200, the plunger member 200 is prevented from rotating freely. It is further envisioned that the predetermined extending point and compression point of the plunger member 200 is determined by the placement of the guide pin 320.

In normal operation the compression spring 310 is extended so that the plunger member 200 is in the extended position (see FIG. 1 and FIG. 7.). However, when sufficient force is applied to the second end 220 of the plunger member 200, the compression spring 310 might compress resulting in the plunger member 200 sliding about the longitudinal axis 130 of the main driver member 100 into a compressed position (see. FIG. 2. and FIG. 8).

It is envisioned that one embodiment of the device 10, might comprise of a plunger member 200 that is fixedly attached to the main driver member 100 so that the plunger member 200 might not be able to slide about the longitudinal axis 130 of the main driver member 100.

In operation, after engaging the first end 110 of the main driver member 100 into a driver means, the user may engage a self drilling drywall anchor using the engaging blades 122 of the main driver member 100 and the plunger member 200.

The engaging blades 122 of the main driver member 100 engage the open end of the self drilling drywall anchor and the plunger member 200 extends inside the axial bore of the anchor until contacting the closed end of the anchor. Once contact is made with the closed end of the anchor, the compression spring 310 of the plunger guiding mechanism 300 is engaged, stabilizing the anchor and minimizing the likelihood of the anchor slipping or wobbling about the main driver member 100 as the anchor is driven into the wall. Once the anchor is driven into the wall, the engaging blades 222 of the plunger member 200 may be used to drive the anchor screw into the anchor without having to adjust the driving device.

An advantage of the present invention is that it provides a drywall anchor installation device that does not require the use of both hands when driving a drywall anchor into drywall.

Another advantage of the present invention is that it provides a drywall anchor installation device that engages a drywall anchor at multiple contact points of the drywall anchor.

A further advantage of the present invention is that it provides a drywall anchor installation device that minimizes the likelihood that a driving device will slip off an anchor when driving the anchor into drywall.

Still a further advantage of the present invention is that it provides a drywall anchor installation device that minimizes the likelihood that a driving device will wobble when driving the anchor into drywall.

Still a further advantage of the present invention is that it provides a drywall anchor installation device that minimizes the risk of injury when driving the anchor into drywall.

Yet, a further advantage of the present invention is that it provides a drywall anchor installation device that minimizes the likelihood of damaging the wall when driving the anchor into drywall.

Although the present invention has been described in considerable detail with reference to certain preferred versions thereof, other versions are possible. Therefore, the spirit and the scope of the claims should not be limited to the description of the preferred versions contained herein.

What is claimed is:

1. A drywall anchor installation device, the device comprising:

a main driver member having a first end, a second end, a longitudinal axis, a bore, and a central channel extending about its longitudinal axis, the bore traverses the main driver member perpendicular to its longitudinal axis at a position in between the first end of the main driver member and the second end of the main driver member, the central channel has a closed first end and an open second end, the first end of the main driver member is configured to be received by a standard hexagonal driver and the second end of the main driver member is configured to engage a self drilling wall anchor with a Philips head screw top;

a plunger member having a first end, a second end, a longitudinal axis, and a notch, the notch extends about the longitudinal axis of the plunger member at a position that is between the first end of the plunger member and the second end of the plunger member, the second end of the plunger member is configured to engage a standard Philips head screw having a head smaller than the head of the self drilling wall anchor engaged by the main driver member, the plunger member is housed in the central channel of the main driver member in such a way that the plunger member can slide about the longitudinal axis of the main driver member to a predetermined extending point; and a plunger guiding mechanism comprising of a compression spring and a guide pin, the compression spring is positioned between the closed first end of the central channel of the main driver member and the first end of the plunger member, the compression spring further biasing the plunger to an extended position such that the plunger extends from the second end of the main driver member to a predetermined extending point for being received in an axial bore of the self drilling drywall anchor, the guide pin is fixedly received by the bore of the main driver member and positioned so that the guide pin is engaged with the notch of the plunger member so that the plunger member is prevented from fully exiting the central channel of the main driver member when extended and when retracted the second end of the plunger forms in combination with the second end of the main driver member a contiguous end configured to engage a Philips head screw top.

2. The device of claim 1, wherein the second end of the main driver member is configured to engage Philip head screw tops of varying sizes.

3. The device of claim 2, wherein the second end of the plunger member is configured to engage Philip head screw tops of varying sizes.

4. The device of claim 3, wherein the predetermined extending point of the plunger member is determined by the placement of the guide pin.

5. The device of claim 4, wherein the main driver member is composed of a metallic compound.

6. The device of claim 5, wherein the plunger member is composed of a metallic compound.

* * * * *